US007098854B2

(12) United States Patent
Herrick

(10) Patent No.: US 7,098,854 B2
(45) Date of Patent: Aug. 29, 2006

(54) REFLECT ANTENNA

(75) Inventor: Katherine J. Herrick, Chelmsford, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/936,944

(22) Filed: Sep. 9, 2004

(65) Prior Publication Data

US 2006/0049987 A1 Mar. 9, 2006

(51) Int. Cl.
*H01Q 1/38* (2006.01)

(52) U.S. Cl. ..... 343/700 MS; 343/845

(58) Field of Classification Search ..... 343/700 MS, 343/845, 846

See application file for complete search history.

(56) References Cited

U.S. PATENT DOCUMENTS

| | | | | |
|---|---|---|---|---|
| 4,936,144 | A | 6/1990 | Djorup | |
| 5,001,492 | A * | 3/1991 | Shapiro et al. | 343/700 MS |
| 5,392,152 | A | 2/1995 | Higgins et al. | |
| 5,828,339 | A * | 10/1998 | Patel | 343/700 MS |
| 6,069,589 | A * | 5/2000 | Lewis et al. | 343/767 |
| 6,218,989 | B1 * | 4/2001 | Schneider et al. | 343/700 MS |
| 6,236,367 | B1 * | 5/2001 | Du Toit et al. | 343/700 MS |
| 6,384,787 | B1 | 5/2002 | Kim et al. | |
| 6,765,535 | B1 * | 7/2004 | Brown et al. | 343/700 MS |
| 6,801,165 | B1 * | 10/2004 | Fang | 343/700 MS |
| 6,801,168 | B1 * | 10/2004 | Yeh | 343/700 MS |
| 6,864,840 | B1 * | 3/2005 | Zhu et al. | 343/700 MS |
| 2004/0125016 | A1 * | 7/2004 | Atwood et al. | 343/700 MS |
| 2004/0174314 | A1 * | 9/2004 | Brown | 343/767 |

OTHER PUBLICATIONS

David M. Pozar, Design of Millimeter Wave Microstrip Reflectarrays, Feb. 1997, pp. 287-296, vol. 45, No. 2.

S.D. Targonski, Analysis and Design of a Microstrip Reflectarray Using Patches of Variable Size, pp. 1820-1823, University of Massachusetts, Amherst, Massachusetts 01003, no date, month.

Marek E. Bialkowski, Design, Development, and Testing of X-Band Amplifying Reflectarrays, Aug. 2002, pp. 1065-1076, vol. 50, No. 8.

Marek E. Bialkowski, Dual Linearly Polarized Reflect Array Using Aperture Coupled Microstrip Patches. 2001, pp. 486-489, HRL Laboratories, Malibu, CA 90265.

Coplanar Waveguides Supported by InGap and GaAs/A1GaAs Membrane-Like Bridges, 2002, pp. 1-3, no date, month.

Pamela R. Haddad, David M. Pozar, Analysis of Two Aperture-Coupled Cavity-Backed Antennas, Dec. 1997, pp. 1717-1726, vol. 45, No. 12, New York.

Gildas P. Gauthier, Linda P. Katehi and Gabriel M. Rebeiz, A 94 GHz Aperture-Coupled Micromachined Microstrip Antenna, 1998, pp. 993-996, New York.

PCT/US2005/022655 International Search Report dated Jan. 25, 2006.

* cited by examiner

*Primary Examiner*—Don Wong
*Assistant Examiner*—Hung Tran Vy
(74) *Attorney, Agent, or Firm*—Daly, Crowley, Mofford & Durkee,LLP

(57) ABSTRACT

A reflect antenna element having a receive antenna section and a transmit antenna section. Each section has a cavity, a conductive element in registration with the cavity, and a ground plane conductor having a slot. A strip conductor has portions thereof disposed over the slots and the ground planes conductor. The strip conductor and underlying ground plane conductor form a microstrip transmission line for coupling energy received by the receive antenna section to the transmit antenna section. The transmit antenna section and receive antenna section are configured to operate with orthogonal polarizations. An amplifier is disposed in circuit with the transmission line.

22 Claims, 6 Drawing Sheets

REFLECT ANTENNA

TECHNICAL FIELD

This invention relates to reflect antennas and more particularly to reflect array antennas.

BACKGROUND

As is known in the art, reflect array antennas have been used in many applications. One type of reflect array antenna is a microstrip reflect array. The microstrip reflect antenna is essentially a planar array of microstrip patch antennas or dipoles illuminated by a feed. The individual antenna elements scatter the incident field appropriately so that the reflected field has a planar equi-phase front. The concept of a planar reflect array is not new, however, implementations found in the literature use a single antenna element for both transmit and receive. Pozar, et al., in a paper entitled "Design of a Millimeter Wave Microstrip Reflectarrays" published in IEEE Transactions on Antennas and Propagation, Vol. 45, No. 2, February 1997, for example, presented a microstrip reflect array of unique patch antennas, each sized for appropriate phasing, in which the same antenna element receives and transmits. With the exception that each antenna element is unique, the single substrate structure is comprised of rectangular patches on one side and a ground plane on the other. Bialkowski et al. have implemented a microstrip reflect array at X-band using aperture coupled patch antennas as reported in an article entitled "Design, Development, and Testing of X-Band Amplifying Reflectarrays" and published in IEEE Transactions on Antennas and Propogation, Vol. 50, August 2002. Isolation between transmit and receive have proven difficult with this approach since only one antenna is used with orthogonal slots for both transmit and receive. Further, U.S. Pat. No. 6,384,787 describes a flat reflectarray antenna.

SUMMARY

In accordance with the present invention, a reflect antenna element is provided having a receive antenna section and a transmit antenna section. Each section has an air cavity, a ground plane conductor with a slot, and a conductive element in registration with the slot and cavity. A strip conductor and ground plane conductor form a microstrip transmission line for coupling energy received by the receive antenna section to the transmit antenna section. The transmit antenna section and receive antenna section are configured to operate with orthogonal polarizations.

In one embodiment, an amplifier is disposed in circuit with the transmission line.

In accordance with another feature of the invention, an antenna element is provided having a receive antenna section and a transmit antenna section. The receive antenna section includes: (i) a receive patch conductor disposed on a first portion of a first surface of first one of a pair of overlying substrates; (ii) a receive cavity disposed in a first portion of the first one of the substrates, such receive cavity being in registration with the receive patch conductor, a first inner portion of the first one of the pair of substrates being disposed between the receive cavity and the receive patch conductor, such receive cavity having an elongated portion and (iii) a ground plane conductor having a receive slot therein, such receive slot having an entrance for receiving energy the receive cavity. The transmit antenna section includes: (i) a transmit patch conductor disposed on second portion of the first surface of the first one of the pair of substrates, such second portion of the first surface of the first one of the pair of substrates and the second portion of the first one of the substrates being laterally spaced one from the other along the first surface of the first one of the pair of substrates; (ii) a transmit cavity disposed in a second portion of the first one of the substrates, such transmit cavity being in registration with the transmit patch conductor, a second inner portion of the first one of the pair of substrates being disposed between the transmit cavity and the transmit patch conductor, such transmit cavity having an elongated portion and (iii) wherein the ground plane conductor has a transmit slot therein, such transmit slot having an entrance for transmitting energy into the transmit cavity. A strip conductor is provided having portions thereof disposed over the receive slot and the transmit slot and disposed on a surface of a second one of the pair of substrates, such strip conductor, underlying portions of the second one of the pair of substrates, and underlying portions of the ground plane conductor forming a microstrip transmission line for coupling energy received by the receive antenna section to the transmit antenna section. Elongated portion of the receive cavity is disposed along a first direction and the elongated portion of the transmit cavity is disposed along a second direction, the first direction being perpendicular to the second direction.

With such an arrangement, separate transmit and receive aperture coupled patch antenna sections are used for improved isolation and an orthogonal polarization twist. In addition, micromachining or photolithograhic-etching processes of a semiconductor substrate underneath the patch antenna sections adds bandwidth and reduces surface waves. This two-substrate, i.e., two-layer, architecture allows for active array implementation by replacing the lower feed layer with a power amplifiers (PA) which is completely shielded from the incident radiation to the antenna sections by a ground plane conductor.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
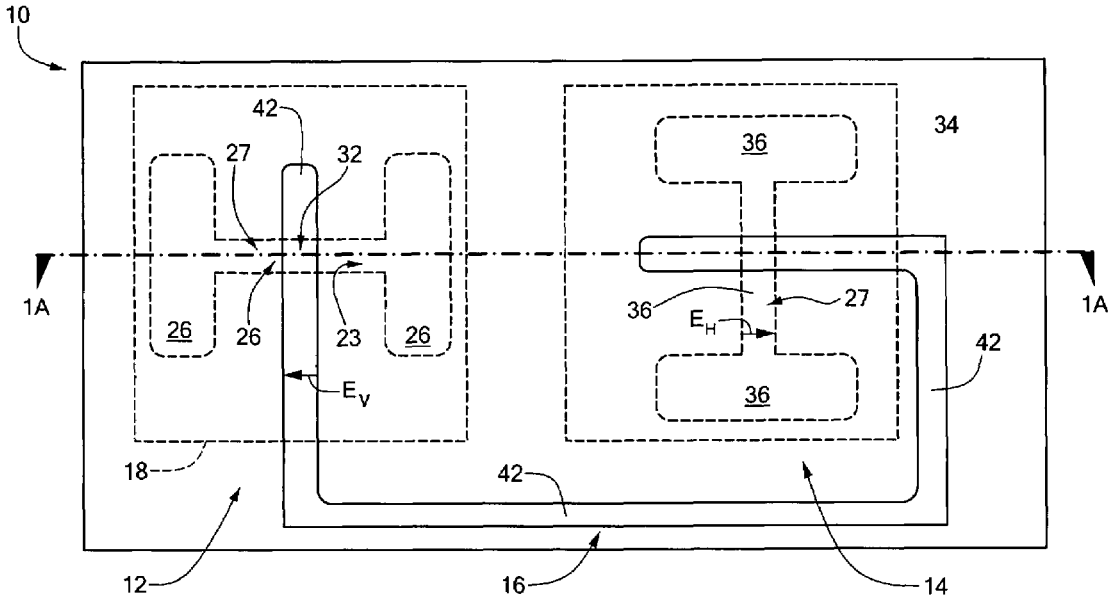
FIG. 1 is a top view of a reflect antenna element according to the invention.
Figure 1A:
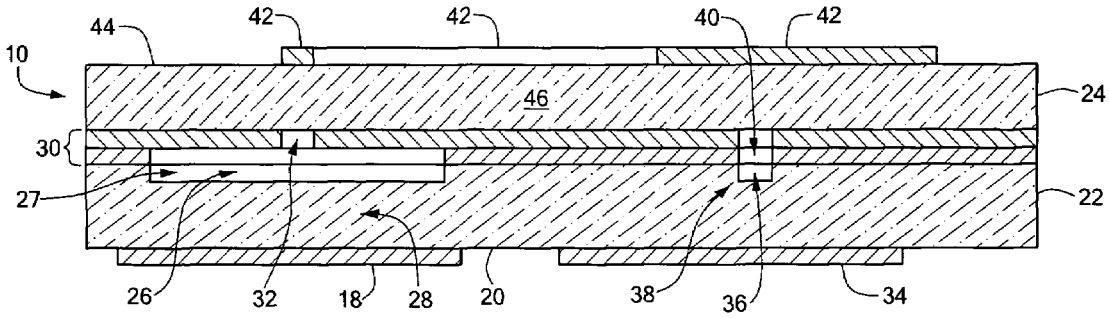
FIG. 1A is a cross-sectional view of the reflect array antenna of FIG. 1, such cross-section being taken along line 1A—1A in FIG. 1.
Figure 3:
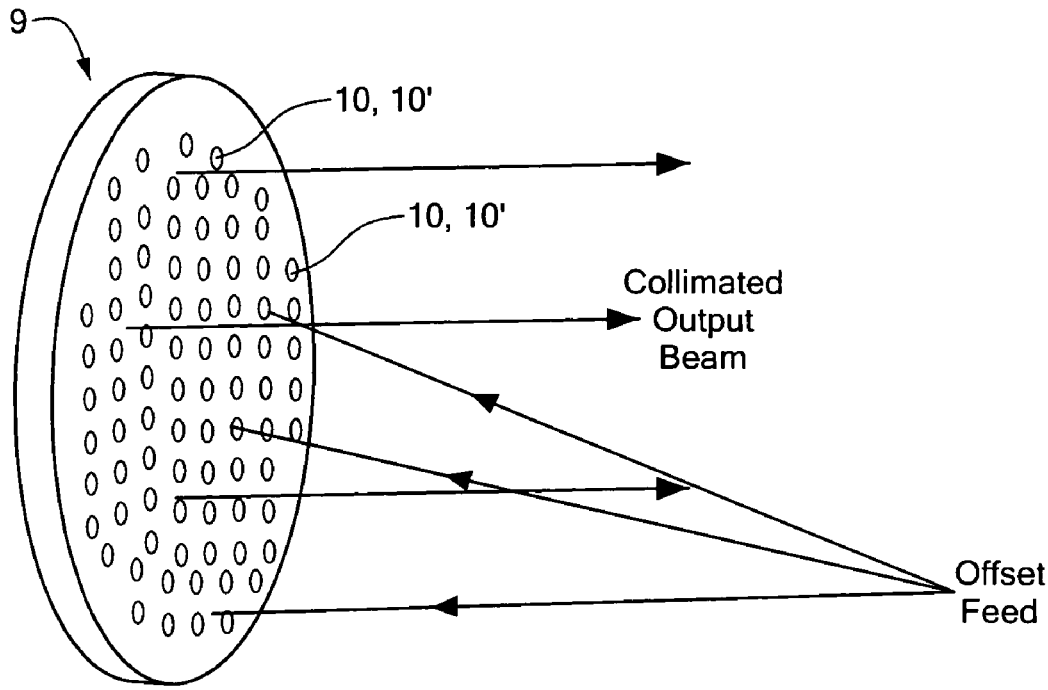
FIG. 3 is a reflectarray antenna according to the invention, such antenna having as the array elements thereof the antenna elements of either FIG. 1 or FIG. 2.

Referring now to FIGS. 1 and 1A, an antenna element 10 for a reflect array antenna 9, FIG. 3, is shown to include: a receive antenna section 12; a transmit antenna section 14; and a strip transmission line 16 for coupling energy received by the receive antenna section 12 to the transmit antenna section 14.

The receive antenna section 12 includes: a receive patch conductor 18 disposed on a first portion of a first surface 20 of a first one of a pair of overlying substrates 22,24, here on surface 20 of substrate 22. Here the substrate 22 is high resistively silicon to provide a dielectric substrate. A receive cavity 26 is disposed in substrate 22 and has an elongated portion 27. The receive cavity 26 is in registration with, here aligned directly behind, the receive patch conductor 18. An inner portion 28 of the first substrate 22 is disposed between the receive cavity 16 and the receive patch conductor 18. The receive antenna section 12 includes a ground plane conductor 30 having an elongated receive slot 32 therein. The receive slot 32 has an entrance for receiving energy in the receive cavity 32.

The transmit antenna section 14 includes a transmit patch conductor 34 disposed on second portion of the first surface 20 of the substrate 22. The receive patch conductor 18 and the transmit patch conductor are laterally spaced one from the other along the first surface 20 substrate 22. The transmit antenna section 14 includes a transmit cavity 36 disposed in a second portion of substrate 22 and has an elongated portion 23. The transmit cavity 36 is in registration with, here aligned directly behind, the transmit patch conductor 34. An inner portion 38 of the substrate 22 is disposed between the transmit cavity 36 and the transmit patch conductor 34. The ground plane conductor 30 has a transmit slot 40 therein. The transmit slot 40 has an entrance for transmitting energy into the transmit cavity 36.

A strip conductor 42 has portions thereof disposed over the receive slot 22 and the transmit slot 36 and disposed on a surface 44 of a second one of the pair of substrates 22, 24, here on substrate 24. Here substrate 24 is of the same material as substrate 22. The strip conductor 62, underlying portions 46 of the substrate 24, and underlying portions of the ground plane conductor 30 form the microstrip transmission line 16 for coupling energy received by the receive antenna section 12 to the transmit antenna section 14.

The elongated portion 27 of the receive cavity 26 is disposed along a first direction, shown as a vertical direction ion FIG. 1 and the elongated portion 23 of the transmit cavity 14 is disposed along a second direction, shown as a horizontal direction in FIG. 1. Thus, the receive cavity 26 supports a vertical electric field vector $E_V$ and the transmit cavity 36 supports a horizontal electric field vector $E_H$. Thus, horizontally polarized energy received at slot 32 of the receive antenna section 12 is transmitted as vertically polarized energy by the transmit antenna section 14.

Figure 1B:
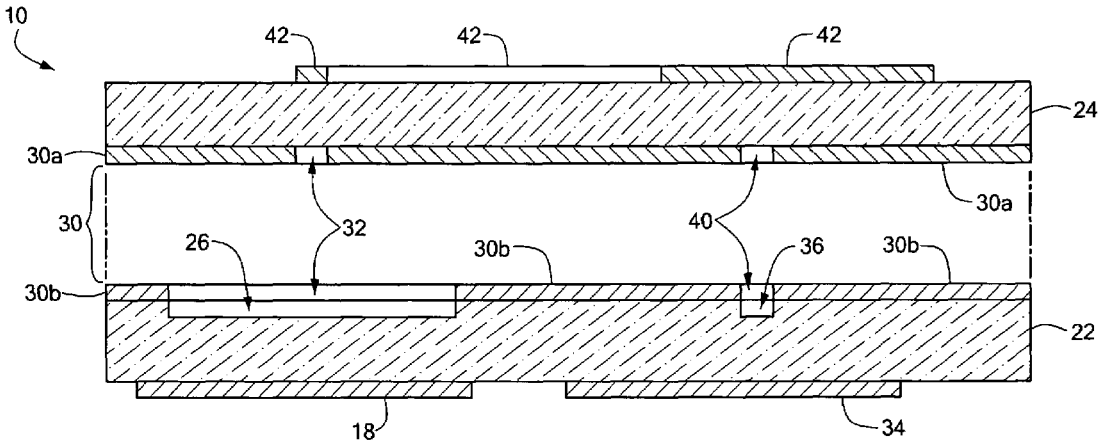
FIG. 1B is an exploded cross-sectional view of the reflect array antenna of FIG. 1, such cross-section being taken along line 1A—1A in FIG. 1.

Referring now to FIG. 1B, it is noted that the substrate 22 has photolithography formed heron the receive and transmit patch conductors 18, 34, receive and transmit cavities 26, 36 and a layer of metal 30*b* forming one half of the ground plane 30 FIG. 1A with portions of receive and transmit slots 32, 40 respectively formed therein. Substrate 24 has a layer 30*a* of metal which provides the other half of the ground plane 30 (FIG. 1A) and the strip conductor 42. The two substrates are bonded together with any suitable conductive epoxy for example, not shown.

Figure 2:
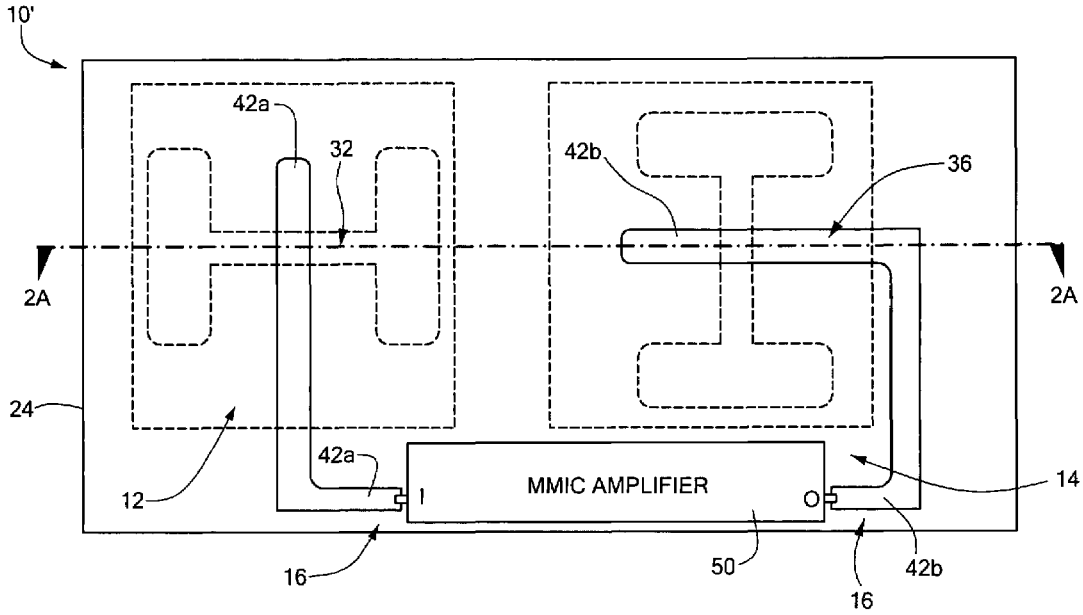
FIG. 2 is a plan view of an reflect antenna element according to an alternative embodiment of the invention.
Figure 2A:
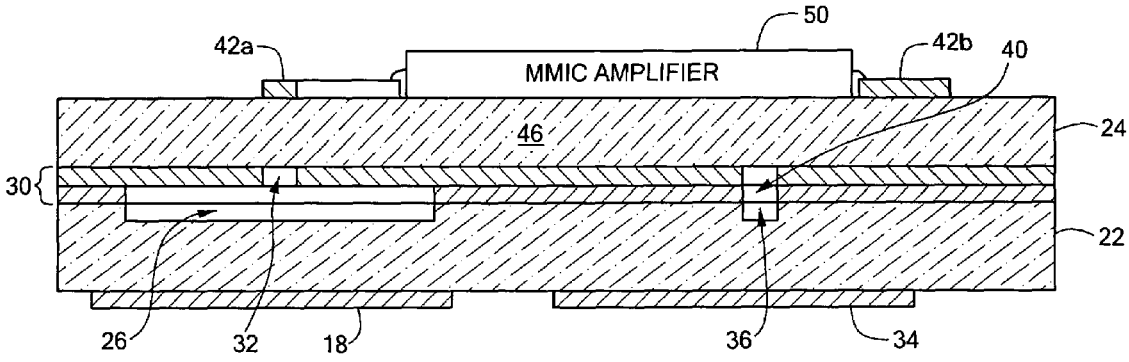
FIG. 2A is a cross-sectional view of the reflect array antenna of FIG. 2, such cross-section being taken along line 2A—2A in FIG. 2.

Referring now to FIGS. 2 and 2A, a reflect antenna element 10' is shown. Here a microwave monolithic integrated circuit MMIC amplifier 50 is disposed in circuit with the transmission line 16. Thus, the strip conductor 42 in FIG. 1 is separated into two sections 42*a* and 42*b* as shown in FIGS. 2 and 2A. Strip conductor section 32*a* is connected to the input (I) of the MMIC amplifier 50 and strip conductor portion 42*b* is connected to the output (O) of the MMIC amplifier 50. Strip conductor portion 42*a* is disposed over receive slot 32 and strip conductor portion 42*b* is disposed over transmit slot 36, as shown in FIG. 2.

The use of a two-substrate structure 10, 10' described above allows space for transmit/receive (T/R) elements while keeping them sufficiently isolated. Micromachining or partially etching the silicon from behind the patch conductive elements maintains the isolation, and prevents surface waves The antennas 10, 10' have the following features:

Separate transmit and receive antenna sections

Micromachined aperture coupled patches

Polarization twist with isolation

True time delay by varying length of microstrip feed lines

By replacing the microstrip feed line with a power amplifier 50 as in FIGS. 2 and 2A active array may be created. With this approach, the array antenna 9 (FIG. 3) is minimally impacted, if impacted at all. Rather than share unit cell space with the antennas on the same layer, placing the power amplifier 50 behind the unit cell (i.e., behind antenna 10') allows maximum lateral footprint tolerances to be employed. For example, at 95 GHz, half a free space wavelength is 1.6 mm. For most applications this 1.6 mm defines the unit cell footprint at 95 GHz.

A number of embodiments of the invention have been described. Nevertheless, it will be understood that various modifications may be made without departing from the spirit and scope of the invention. Accordingly, other embodiments are within the scope of the following claims.

What is claimed is:

1. A reflect antenna element, comprising:

a receive antenna section and a transmit antenna section, each antenna section having:

a dielectric having a cavity therein;

a conductive element in registration with the cavity; and a ground plane conductor having a slot;

a strip conductor having portions thereof disposed over the slot and the ground plane conductor;

wherein the strip conductor and underlying ground plane conductor form a microstrip transmission line for coupling energy received by the receive antenna section to the transmit antenna section; and wherein the transmit antenna section and receive antenna section are configured to operate with orthogonal polarizations.

2. A reflect antenna element, comprising:

a receive antenna section and a transmit antenna section each antenna section having:

cavity;

a conductive element in registration with the cavity; and a ground plane conductor having a slot;

a strip conductor having portions thereof disposed over the slot and the ground plane conductor;

wherein the strip conductor and underlying ground plane conductor form a microstrip transmission line for coupling energy received by the receive antenna section to the transmit antenna section; and wherein the transmit antenna section and receive antenna section are configured to operate with orthogonal polarizations; and including an amplifier disposed in circuit with the transmission line.

3. A reflect antenna element, comprising:

(A) a receive antenna section, comprising:

a receive dielectric portion having a receive cavity therein;

a receive conductive element in registration with the receive cavity;

a receive antenna ground plane conductor having an receive slot, such strip conductor being spaced from the receive conductive element, such receive slot being arranged to receive energy in the receive cavity;

a strip conductor having portions thereof disposed over the receive slot and disposed over the receive ground plane conductor, such strip conductor and underlying receive ground plane conductor forming a microstrip transmission line for coupling energy received by the receive slot from the receive cavity;

(B) a transmit antenna section, comprising:

a transmit dielectric portion having a transmit cavity therein;

a transmit conductive element in registration with the transmit cavity;

a transmit antenna ground plane conductor having a transmit slot, such strip conductor being spaced from the transmit conductive element, such transmit slot being arranged to transmit energy into the transmit cavity;

a strip conductor having portions thereof disposed over the transmit slot and disposed over the transmit ground plane conductor, such strip conductor and underlying transmit antenna aground plane conductor forming a microstrip transmission line for coupling energy from the transmit slot to the transmit cavity; and (C) wherein the transmit antenna section and receive antenna section are configured to operate with orthogonal polarizations.

4. The antenna element recited in claim 3 wherein strip conductor has portions thereof disposed over the receive slot and the strip conductor having portions thereof disposed over the transmit slot are a continuous strip conductor.

5. The antenna element recited in claim 3 wherein: the receive cavity has an elongated portion; the transmit cavity has an elongated portion slot is an elongated slot; and the elongated portion of the receive cavity is perpendicular to the elongated portion of the transmit cavity.

6. The antenna element recited in claim 5 including an amplifier having an input connected to the strip conductor having portions thereof disposed over the receive slot and an output connected to the strip conductor having portions thereof disposed over the transmit slot.

7. The antenna element recited in claim 6 wherein receive conductive element and the transmit antenna element are patch conductors.

8. The antenna element recited in claim 7 the receive antenna ground plane conductor and the transmit ground plane conductor provide a common ground plane for the reflect antenna element.

9. The antenna element recited in claim 8 wherein: the receive cavity has an elongated portion; the transmit cavity has an elongated portion slot is an elongated slot; and the elongated portion of the receive cavity is perpendicular to the elongated portion of the transmit cavity.

10. The antenna element recited in claim 9 wherein receive conductive element and the transmit antenna element are patch conductors.

11. The antenna element recited in claim 10 including an amplifier disposed in circuit with the transmission line.

12. The antenna element recited in claim 5 wherein strip conductor having portions thereof disposed over the receive slot and the strip conductor having portions thereof disposed over the transmit slot are a continuous strip conductor.

13. A reflect antenna element, comprising:

(A) a receive antenna section, comprising:

a receive cavity;

a receive conductive element in registration with the receive cavity;

a receive antenna ground plane conductor having an receive slot, such strip conductor being spaced from the receive conductive element, such receive slot being arranged to receive energy in the receive cavity;

a strip conductor having portions thereof disposed over the receive slot and disposed over the receive ground plane conductor, such strip conductor and underlying receive ground plane conductor forming a microstrip transmission line for coupling energy received by the receive slot from the receive cavity;

(B) a transmit antenna section, comprising:

a transmit cavity;

a transmit conductive element in registration with the transmit cavity;

a transmit antenna ground plane conductor having a transmit slot, such strip conductor being spaced from the transmit conductive element, such transmit slot being arranged to transmit energy into the transmit cavity;

a strip conductor having portions thereof disposed over the transmit slot and disposed over the transmit ground plane conductor, such strip conductor and underlying transmit antenna aground plane conductor forming a microstrip transmission line for coupling energy from the transmit slot to the transmit cavity; and (C) wherein the transmit antenna section and receive antenna section are configured to operate with orthogonal polarizations; and;

(D) including an amplifier having an input connected to the strip conductor having portions thereof disposed over the receive slot and an output connected to the strip conductor having portions thereof disposed over the transmit slot.

14. An antenna element comprising:

a substrate having a receive cavity and a transmit cavity formed in laterally spaced regions thereof, the receive cavity having an elongated portion and the transmit cavity having an elongated portion;

a receive conductive element and a transmit conductive element disposed on the substrate in registration with the receive cavity and the transmit cavity, respectively;

a ground plane conductor having an receive slot and a transmit slot therein, such strip conductor being spaced from the receive conductive element and the transmit conductive element by portions of the substrate, such receive slot being arranged to receive energy in the receive cavity and the transmit slot being arranged to transmit energy to the transmit cavity;

a strip conductor having portions thereof disposed over the receive slot and the transmit slot and disposed over the ground plane conductor, such strip conductor and underlying ground plane conductor forming a microstrip transmission line for coupling energy received by the receive slot from the receive cavity to the transmit cavity through the transmit slot; and wherein the elongated portion of the receive cavity is perpendicular to the elongated portion of the transmit cavity.

15. An antenna element, comprising:

(A) a receive antenna section comprising:

(i) a receive patch conductor disposed on a first portion of a first surface of a first one of a pair of overlying substrates;

(ii) a receive cavity disposed in a first portion of the first one of the substrates, such receive cavity being in registration with the receive patch conductor, a first inner portion of the first one of the pair of substrates being disposed between the receive cavity and the receive patch conductor, such receive cavity having an elongated portion;

(iii) a ground plane conductor having an receive slot therein, such receive slot having an entrance for receiving energy in the receive cavity;

(B) a transmit antenna section comprising:

(i) a transmit patch conductor disposed on second portion of the first surface of the first one of the pair of substrates, such second portion of the first surface of the first one of the pair of substrates and the second portion of the first one of the substrates being laterally spaced one from the other along the first surface of the first one of the pair of substrates;

(ii) a transmit cavity disposed in a second portion of the first one of the substrates, such transmit cavity being in registration with the transmit patch conductor, a second inner portion of the first one of the pair of substrates being disposed between the transmit cavity and the transmit patch conductor, such transmit cavity having an elongated portion; and (iii) wherein the ground plane conductor has a transmit slot therein, such transmit slot having an entrance for transmitting energy into the transmit cavity; and (C) a strip conductor having portions thereof disposed over the receive slot and the transmit slot and disposed on a surface of a second one of the pair of substrates, such strip conductor, underlying portions of the second one of the pair of substrates, and underlying portions of the ground plane conductor forming a microstrip transmission line for coupling energy received by the receive antenna section to the transmit antenna section; and (D) wherein elongated portion of the receive cavity is disposed along a first direction and the elongated portion of the transmit cavity is disposed along a second direction, the first direction being perpendicular to the second direction.

16. The antenna element recited in claim 15 including an amplifier disposed in circuit with the transmission line.

17. A reflect antenna element, comprising:

a receive antenna section and a transmit antenna section, each antenna section having:

material having a cavity therein;

a conductive element in registration with the cavity; and a ground plane conductor having a slot;

a strip conductor having portions thereof disposed over the slot and the ground plane conductor;

wherein the strip conductor and underlying ground plane conductor form a microstrip transmission line for coupling energy received by the receive antenna section to the transmit antenna section; and wherein the transmit antenna section and receive antenna section are configured to operate with orthogonal polarizations; and wherein the strip conductor has a pair of ends, each one of the ends terminating in a corresponding one of the receive antenna section and the transmit antenna section.

18. A reflect antenna element, comprising:

a receive antenna section and a transmit antenna section, each antenna section having:

material having a cavity therein;

a conductive element in registration with the cavity; and a ground plane conductor having a slot;

a strip conductor having portions thereof disposed over the slot and the ground plane conductor;

wherein the strip conductor and underlying ground plane conductor form a microstrip transmission line for coupling energy received by the receive antenna section to the transmit antenna section; and wherein the transmit antenna section and receive antenna section are configured to operate with orthogonal polarizations; and wherein the receive antenna section and the transmit antenna section are configured to operate at a common frequency.

19. The antenna element recited in claim 18 wherein the strip conductor has a pair of ends, each one of the ends terminating in a corresponding one of the receive antenna section and the transmit antenna section.

20. The antenna element recited in claim 19 wherein: the receive cavity has an elongated portion; the transmit cavity has an elongated portion slot is an elongated slot; and the elongated portion of the receive cavity is perpendicular to the elongated portion of the transmit cavity.

21. The antenna element recited in claim 20 wherein receive conductive element and the transmit antenna element are patch conductors.

22. The antenna element recited in claim 21 the receive antenna ground plane conductor and the transmit ground plane conductor provide a common ground plane for the reflect antenna element.

* * * * *

UNITED STATES PATENT AND TRADEMARK OFFICE

CERTIFICATE OF CORRECTION

PATENT NO. : 7,098,854 B2
APPLICATION NO. : 10/936944
DATED : August 29, 2006
INVENTOR(S) : Herrick It is certified that error appears in the above-identified patent and that said Letters Patent is hereby corrected as shown below:

TITLE PAGE, ITEM (57)
ABSTRACT lines 5-6 delete “ground plates conductor” and replace with --ground plane conductor--.

Column 1, line 57 delete “of first one” and replace with --of a first one--.

Column 1, line 66 delete “energy the” and replace with --energy to the--.

Column 1, line 67 delete “disposed on second” and replace with --disposed on a second--.

Column 2, line 22 delete “Elongated portion” and replace with --The elongated portion--.

Column 2, line 37 delete “a power amplifiers” and replace with --a power amplifier--.

Column 2, line 57 delete “an reflect” and replace with --a reflect--.

Column 3, line 12 delete “surface 20” and replace with --first surface 20--.

Column 3, line 12 delete “is high” and replace with --is a high--.

Column 3, line 24 delete “disposed on second” and replace with --disposed on a second--.

Column 3, line 27 delete “first surface 20 substrate 22” and replace with --first surface 20 of substrate 22--.

Column 3, line 48 delete “ion FIG.1” and replace with --in FIG.l--.

Column 3, line 57 delete “formed heron” and replace with --formed here on--.

Column 3, line 60 delete “plane 30 FIG. 1A” and replace with --plane 30 (FIG. 1A)--.

Column 3, line 65 delete “epoxy for example,” and replace with --epoxy, for example,--.

Column 4, line 15 delete “waves” and replace with --waves.--.

Column 4, line 22, delete “FIGS. 2 and 2A active array” and replace with -- FIGS.2 and 2A, an active array--.

UNITED STATES PATENT AND TRADEMARK OFFICE

CERTIFICATE OF CORRECTION

PATENT NO. : 7,098,854 B2
APPLICATION NO. : 10/936944
DATED : August 29, 2006
INVENTOR(S) : Herrick It is certified that error appears in the above-identified patent and that said Letters Patent is hereby corrected as shown below:

Column 5, lines 12-13 delete “an receive” and replace with --a receive--.

Column 5, line 37 delete “aground” and replace with --ground--.

Column 5, line 44 delete “wherein strip” and replace with --wherein the strip--.

Column 5, line 58 delete “wherein receive” and replace with --wherein the receive--.

Column 5, line 61 delete “claim 7 the receive” and replace with --claim 7 wherein the receive--.

Column 6, lines 3-4 delete “wherein receive” and replace with --wherein the receive--.

Column 6, line 8 delete “wherein strip” and replace with --wherein the strip--.

Column 7, line 23 delete “an receive” and replace with --a receive--.

Column 7, line 27 delete “on second” and replace with --on a second--.

Column 7, line 53 delete “wherein elongated” and replace with --wherein the elongated--.

Column 8, lines 51-52 delete “wherein receive” and replace with --wherein the receive--.

UNITED STATES PATENT AND TRADEMARK OFFICE

CERTIFICATE OF CORRECTION

PATENT NO. : 7,098,854 B2
APPLICATION NO. : 10/936944
DATED : August 29, 2006
INVENTOR(S) : Herrick It is certified that error appears in the above-identified patent and that said Letters Patent is hereby corrected as shown below:

Column 8, line 54 delete "claim 21 the receive" and replace with --claim 21 wherein the receive--.

Signed and Sealed this

Twentieth Day of February, 2007

JON W. DUDAS
*Director of the United States Patent and Trademark Office*